US011345007B2

(12) United States Patent
Diaz De Rada Lorente et al.

(10) Patent No.: US 11,345,007 B2
(45) Date of Patent: May 31, 2022

(54) TOOL FOR INSERTING AND REMOVING TEMPORARY FASTENERS

(71) Applicant: LOXIN 2002, S.L., Navarra (ES)

(72) Inventors: Carlos Diaz De Rada Lorente, Navarra (ES); Carlos Ganchegui Iturria, Navarra (ES); Javier Galarza Cambra, Navarra (ES)

(73) Assignee: LOXIN 2002, S.L., Navarra (ES)

( * ) Notice: Subject to any disclaimer, the term of this patent is extended or adjusted under 35 U.S.C. 154(b) by 460 days.

(21) Appl. No.: 16/495,653

(22) PCT Filed: Mar. 27, 2018

(86) PCT No.: PCT/ES2018/070248

§ 371 (c)(1),
(2) Date: Sep. 19, 2019

(87) PCT Pub. No.: WO2018/178466

PCT Pub. Date: Oct. 4, 2018

(65) Prior Publication Data

US 2020/0016730 A1 Jan. 16, 2020

(30) Foreign Application Priority Data

Mar. 31, 2017 (ES) ..... P201730589

(51) Int. Cl.
*B25B 27/00* (2006.01)
*B25B 31/00* (2006.01)

(52) U.S. Cl.
CPC ..... *B25B 31/005* (2013.01)

(58) Field of Classification Search
CPC ..... B25B 31/00; B25B 31/005; B25B 27/00; B25B 27/005; B25B 23/00; B25B 23/0035
See application file for complete search history.

(56) References Cited

U.S. PATENT DOCUMENTS 4,938,108 A * 7/1990 Mekler ..... B25B 13/20 411/407
7,735,400 B2 * 6/2010 Chen ..... B25B 15/001 81/429

(Continued)

FOREIGN PATENT DOCUMENTS

EP 0466609 A1 1/1992
EP 2458232 A1 5/2012

(Continued)

OTHER PUBLICATIONS

International Search Report for corresponding PCT application No. PCT/ES2018/070248, dated Jul. 12, 2018.

*Primary Examiner* — Lee D Wilson
(74) *Attorney, Agent, or Firm* — Notaro, Michalos & Zaccaria P.C.

(57) ABSTRACT

A tool for insertion and extraction of temporary fasteners that enables by a plurality of retractable elements, an automatic engagement of the tool on the head of the temporary fastener, without the need for any rotation of the tool with regard to the head, and by lockable grasping units, operated internally locking elements, a high retention and extraction force is achieved, favouring the elimination of the risk of the clamp detaching itself from the tool, enabling control of the entire insertion and extraction process of temporary fasteners. Rapid, effective automation of the use and procedure of the temporary fasteners can be achieved, improving economic profitability and the reliability of their use.

12 Claims, 10 Drawing Sheets

(56) References Cited

U.S. PATENT DOCUMENTS

| | | | | |
|---|---|---|---|---|
| 2009/0188352 | A1* | 7/2009 | Huang | B25B 23/0035 81/438 |
| 2010/0308171 | A1 | 12/2010 | Kelley et al. | |
| 2013/0039716 | A1 | 2/2013 | McClure | |
| 2020/0016730 | A1* | 1/2020 | Diaz De Rada Lorente | B25B 13/06 |

FOREIGN PATENT DOCUMENTS

| | | | |
|---|---|---|---|
| EP | 2669051 | A1 | 12/2013 |
| EP | 3108148 | A1 | 12/2016 |
| ES | 2388956 | T3 | 10/2012 |
| WO | 2009115691 | A2 | 9/2009 |
| WO | 2013120156 | A1 | 8/2013 |
| WO | 2014187821 | A1 | 11/2014 |
| WO | 2015091335 | A1 | 6/2015 |

* cited by examiner

TOOL FOR INSERTING AND REMOVING TEMPORARY FASTENERS

The present specification, as its title indicates, relates to a tool for the insertion and extraction of temporary fasteners that enables, by means of a plurality of retractable elements, an automatic grip of the tool on the head of the temporary fastener, without the need for any rotation of said tool with regard to said head, and by means of grasping items that can be locked internally by means of locking thrusters, a high degree of retention and extraction is achieved, favouring the elimination of the risk of the fastener detaching itself from the tool.

FIELD OF THE INVENTION

The invention relates to the field of the use of temporary fasteners, in the field of assembly or pre-assembly, especially in the aeronautical industry.

STATE OF THE ART

Temporary fasteners, also known as temporary grippers, temporary rivets, "single side temporary fasteners SSTF" or simply temporary fasteners, are widely used to hold together different parts of aeronautical assemblies. They are commonly used to attach one component to another in the correct position during machining operations. At the same time, they maintain the plates totally flush with each other in such a way that, during their subsequent drilling, the entry of shavings between the layers is avoided, and also maintaining the centring of holes in the different plates.

These assemblies are finally riveted with definitive rivets instead of temporary rivets. In the past, depending on the processes, non-removable temporary rivets were used; these were then destroyed for the insertion of the definitive rivets. This method is costly, so lately temporary rivets are used, which have the advantage of being reusable.

These are their main functions, although depending on the production processes, the type of fastener required and the quantity to be used can vary greatly.

The morphology of these mechanisms is based on an outer body and an inner body. By maintaining the outer body immobile, and turning the inner body, it is possible to change the fastener from its relaxed state (open fastener), where it does not clamp the assembly, to its working state (closed fastener), where it clamps the assembly. The outer and inner bodies feature some kind of splined, hexagonal, torx, or notched shape, or any shape that can transmit the rotation. The outer body likewise features a radial channel, which facilitates its axial attachment to the tool for rivet handling, insertion and extraction.

BACKGROUND OF THE INVENTION

There exist several patents related to this technology. For example, patent US2010308171 "Method of Manufacturing Aircraft Using Temporary Fasteners" describes the assembly or fastening procedure using this type of temporary fasteners, but without specifying any type of specific tool for their application, in addition to which, due to the design of the temporary fastener, the automation of both installation and extraction is complicated.

Other documents describe different variants of embodiments of temporary attachments, as may be found for example in the patents WO2009115691 "Reusable temporary fastening device for pre-assembling at least two previously perforated structural members", ES2388956 "Screw fastening clamp and its use for the temporary fastening of a perforation grid on elements to be assembled", EP2458232 "Attachment means with an end cavity in a threaded terminal, male element, operation tool and gauge comprising such a male element", WO2015091335 "Temporary fastener", EP3108148 "One piece screws for, and methods for making and using, blind side fasteners and systems with free spin feature" or US2013039716 "Temporary fasteners".

Also known are a number of patents that describe specific tools for temporary fasteners, as found in WO2014187821 "Device for applying temporary fasteners", EP2669051—"Family of temporary fasteners and device for applying such fasteners" and WO2013120156 "Tool for semiautomatic application and removal of multiple temporary fasteners", although all of these have certain operating issues, as will be detailed below.

The use of these known tools and temporary fasteners should theoretically require almost zero force for their axial extraction, but experimental results and experience reveal that this is not the case. Depending on the process, this effort can be between zero and about 500 Newtons. However, there are repeated cases in which it is not possible to remove the fastener with this force. What makes this effort greater is the warping or distortion and the relative displacement that the items held in place by the temporary joins may suffer between the time of inserting the temporary fastener and the time of its extraction. Usually the moment when the fastener is inserted is when a few holes are drilled in the assembly plates, in order to hold them and to proceed with the automatic drilling of the remainder of the holes. Automatic drilling is usually carried out at a different station from that of inserting the temporary fasteners. In the transfer of the pre-assembled assembly from one station to another, or the rotation of the same, it may occur that these plates slide slightly over each other, enough to radially grasp the rod of the fasteners. It is in this process that the need to extract the fasteners with considerable force arises. It has been determined that, due to the maximum stresses undergone by the aircraft, or the material of the plates, in many cases it is not possible to extract the fasteners with all the force that is desired, or that may be necessary in each case.

Some of the current existing nozzles usually feature a female hexagon, and the rivet a male hexagonal head, so when the female approaches the male, there are many occasions where they do not engage at the first attempt. To engage correctly, the body of the tool features a helical groove and the nozzle features a pin that slides through said groove, or vice versa. At the moment of attempting to engage, if they do not match, the body continues to move forward and the nozzle retracts, so by means of the helical groove and the pin, the nozzle is forced to rotate, until the moment arrives when the geometric shapes of the head of the fastener and the nozzle of the tool match, and engage.

During this process, the fastener must be firmly fixed to the product, preventing it from rotating. In the event of its rotating, it may rotate solidarily with the nozzle in such a way that it does not engage, which in addition to affecting the process, directly affects the reliability of the system as it may cause scratches or distortions in the surface of the component of the aircraft. Likewise, when the fastener is taken from certain types of fastener stores, such as for example those consisting of a plate with a grid with holes in which the temporary fasteners are loaded or placed for their insertion into the product, the fastener must be closed in this store with sufficient torque so that this possibility of failure does not exist. This means that the operator has to load the fasteners in the store and close them with the appropriate torque, and also that the machine has to open them so that they can be transferred to the product and inserted. This directly affects the time of the cycle, as it results in longer operating times, which result in a higher economic cost of their insertion.

Be that as it may, with today's tools, it is always necessary to ensure that the fastener cannot rotate when collected by the tool, and the easiest way to ensure this is usually to use the fastener's own tightening. As the fasteners have a limited life, that is, they can withstand only a certain number of opening and closing cycles due to fatigue, having to do so for stores such as those described above and/or with current tools, reduces their use to half of their useful life.

These aforementioned current tools use balls associated with an elastic ring, claws or various types of elastic attachment, which enter into the groove of the fastener, to hold the clamp in the tool nozzle. The balls open, forced by the chamfer of the fastener, but at the same time they are held by the elastic ring. The axial force preventing the nozzle from engaging and/or harbouring the head of the fastener is increased by the balls or claws, which are radially pushed towards the centre of the nozzle by the elastic ring, and grasp the head of the fastener. This forces the tool nozzle to require an axial displacement while it is inserted into the head of the fastener, and to have to exert a greater axial force at the moment of engaging the nozzle and the head of the fastener. It is common that this axial displacement involves a helical groove in the tool in such a way that when the nozzle undergoes this axial force and in turn moves, a torsional force is produced in the nozzle, caused by said helical groove, the intention being that the nozzle rotates slightly in order to aid in its engagement with the geometry of the rivet head. Due to the principle of action and reaction, this causes the nozzle to tend to rotate and to transmit that torque directly to the fastener, and that there is also a considerable force between the pin holding the nozzle and the helical groove. This causes the added issue of a reduction in useful life due to wear between the pin and the groove, it not being possible to integrate rolling devices into these tools due to space limitations. Likewise, this axial force is exerted directly on the fastener, which causes additional wear thereon, contributing to the reduction in the useful life of the tool.

When gripped by the elastic systems of the current tools, when the fastener butts against the stop of the nozzle, the balls enter the groove of the fastener, forced by the elastic ring. By monitoring the force of the shaft which moves the body forward, it may be detected that the nozzle has butted against the tool and the movement is halted in order to continue with the next step; however, the detection of force by means of the shaft is complex and difficult to adjust, therefore being unreliable, as well as entailing a high economic cost.

The axial force that can be exerted with the elastic ring is about 50 Newtons. According to the issues explained above regarding the process, up to 1000 Newtons may be necessary to extract the clamps on some occasions, or even more. With these tools it is not possible to increase the extraction force to these levels. Furthermore, should the strength of the elastic ring be increased, at the same time all the aforementioned forces related thereto would increase, and the issues would be exacerbated. It is not possible to achieve the necessary force for extraction, so in many cases manual extraction is necessary, using a hammer, which causes a deterioration of the fasteners, is dangerous for the material being worked on, requires human intervention and greatly slows down the process; there may even be occasions when the rear of the fastener is not accessible.

There are now designs with locks for the balls or pins in other applications, but until now they had never been applied in the use of temporary fasteners of this type.

DESCRIPTION OF THE INVENTION

In order to solve the current problems in the field of aeronautical manufacturing regarding the automated use of temporary fasteners in machining processes, the tool for the insertion and extraction of temporary fasteners, which is the subject of this invention, has been designed.

The tool is equipped with a nozzle for the temporary fastener, with a cylindrical opening that comprises:

- one or more retractable elements, preferably of a cylindrical shape, inserted in their respective axially disposed housings, and distributed peripherally in the inner part of the nozzle, partially recessed in the inner wall of the nozzle, that cause the automatic engagement of the tool on the head of the temporary fastener, with no need for any rotation of said tool with regard to said head, also preventing the axial float that the tool nozzle must have, resulting in a rigid tool body, with no movement in the nozzle, with fewer parts, and in short, easier to manufacture, cheaper, with much less wear and above all, a much more reliable and robust tool that also reduces operating time
- clamping units, also distributed peripherally on the inside of the nozzle, in a position closer to the exterior and coinciding with the channel of the temporary fastener once inserted into the nozzle, associated with an axially sliding locking system and related to an internally sliding actuating cylinder, held in the locked position by an internal spring, which form a locking and retaining device with a very high retention and traction force on the head of the fastener.
- a key located in the central part of the tool, the head thereof featuring a machined section suited to engage with that required for the rotation of the inner part of the temporary fastener.

These key features axial and rotational movement,

- one or more ejectors disposed parallel to and next to the key, endowed with axial movement.

The retractable elements may adopt an extended position in which each retractable element, independently of the others, is maintained in its position closest to the nozzle opening by the thrust of a spring inserted in the housing, or a retracted position in which, independently of the others, the retractable element, which due to its coincident position is pushed by the head of the temporary fastener when inserted into the nozzle, moves axially into the housing, pressing against the spring. In this way, the retractable elements, depending on their individual position, laterally envelop the head of the temporary fastener, in such a way that there will always be a minimum of locking elements that do not retract and that cause the tool nozzle and the head of the fastener to engage.

The clamping elements can also adopt a free position in which the cylinder and its locking elements slide into the tool, compressing the spring, in such a way that the bevelled extremity of the locking elements remains in a position away from the clamping units, these being free to move within their housings, or a locked position where the cylinder and its locking elements are slid towards the tool nozzle in such a way that the locking elements finally touch the clamping units with one side perpendicular to their possible movement, locking their possible movement.

This tool also has a characteristic operating procedure, which may be separated into two parts, one for the extraction of temporary fasteners already inserted into a component, and the opposite process of inserting temporary fasteners from a store into the component, sharing many common steps.

To remove a temporary fastener installed in a component:

the first step is to engage the tool nozzle with the temporary fastener, with the automatic clamping of the head of the temporary fastener.

secondly, a step of locking of the temporary fastener, the third step is the insertion of the actuator key into the temporary fastener, fourth, a step of releasing the pre-load of the temporary fastener, the fifth step is the extraction of the temporary fastener from the component, in sixth place, a step of releasing the temporary fastener, and the seventh step is the ejection of the temporary fastener into its store.

To carry out the insertion of a temporary fastener into a component, one should proceed as follows:

first of all, the step of engaging the tool nozzle in the temporary fastener, located in the store or received automatically by the feed system, with automatic grasping of the head of the temporary fastener, secondly, a step of locking of the temporary fastener, thirdly, a step of inserting the temporary fastener into the component through a hole drilled previously, fourthly, a step of inserting the actuator key into the temporary fastener, fifth, a step of pre-loading the temporary fastener, in sixth place, a step of releasing the temporary fastener, and seventh, the step of extraction of the tool, leaving the temporary fastener gripped in the component.

Advantages of the Invention

This tool for insertion and extraction of temporary fasteners presented herein provides multiple advantages over the equipment currently available; the most important being that it enables the automatic engagement of the tool on the head of the temporary fastener, as by simply pressing the tool against the head of the fastener it will always link with the latter and the two will engage, avoiding rotation between the two whatever the relative starting positions of both, without the need for any rotation of the tool with regard to said head.

Another important advantage is that it does not matter if the fastener rotates, since the engagement is direct regardless of the relative starting positions of both, solving the aforementioned current issue.

It should also be noted that with this tool there is no axial force when it comes to grasping the fastener, solving the aforementioned current issue.

Since there is no axial force or relative rotation of the nozzle against the head of the fastener at the moment of loading, no torque is applied to the fastener, thus avoiding all the aforementioned issues related therewith, which represents a significant improvement regarding the robustness and quality of current processes.

Also of significance is the fact that the length of the tool body does not vary, unlike some existing tools that use a helical groove that forces the nozzle to rotate until they engage; this entailing that the position of the helical groove is not known, and therefore with what tool length engagement will occur. In this invention the size of the body is invariable; it is therefore always possible to move forward up to a predetermined level, which ensures that the tool is in the correct position to attach the fastener, solving this issue and facilitating the programming of the automated manufacturing equipment.

Another noteworthy advantage is that it is not possible for the fastener to detach itself from the tool, since the locking elements encounter a flat surface which they cannot overcome; it is a device with a lock. In tests on real prototypes, extraction forces higher than 2000 Newtons have been measured, surpassing current equipment fourfold, solving the aforementioned current issue and improving notably the current state of the art.

Another great advantage of the new device lies in that there is no interference between the nozzle-fastener engagement system and the axial grasping system of the fastener. These systems are completely independent, greatly facilitating the design, adjustment and customization of the tool to different processes and fasteners that may be found.

With the tool which is the object of this invention it is not necessary to exert any axial force to eject the fastener from the nozzle; since the fastener is released automatically it is not necessary to overcome any axial force. On the other hand, in current equipment it is usually necessary to overcome the elastic force of non-actuated locking, which frequently causes the fastener to shoot out suddenly when ejected instead of exiting gently, or that the force necessary for ejection is excessive.

Another advantage of the present invention is that it avoids the axial and rotational movements of the nozzle with regard to the body, enabling the grip of the fasteners to be sensed and facilitating the automation thereof.

DESCRIPTION OF THE FIGURES

In order to better understand the object of the present invention, a preferred practical embodiment of a tool for the insertion and extraction of temporary fasteners is portrayed in the annexed drawing. In the drawings.

PREFERRED EMBODIMENT OF THE INVENTION

Figure 1:
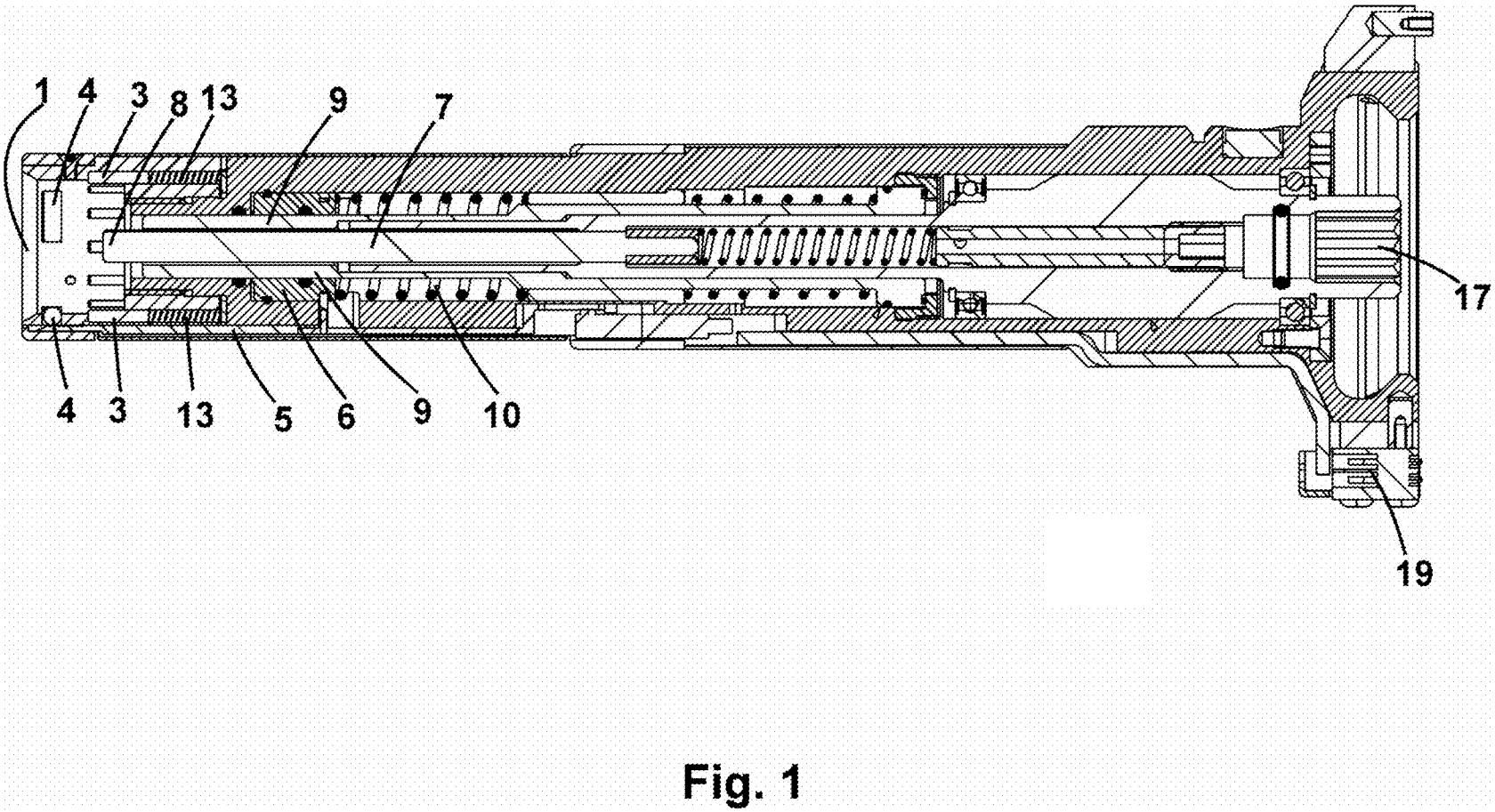
FIG. 1 portrays a sectional side view of the tool.
Figure 2:
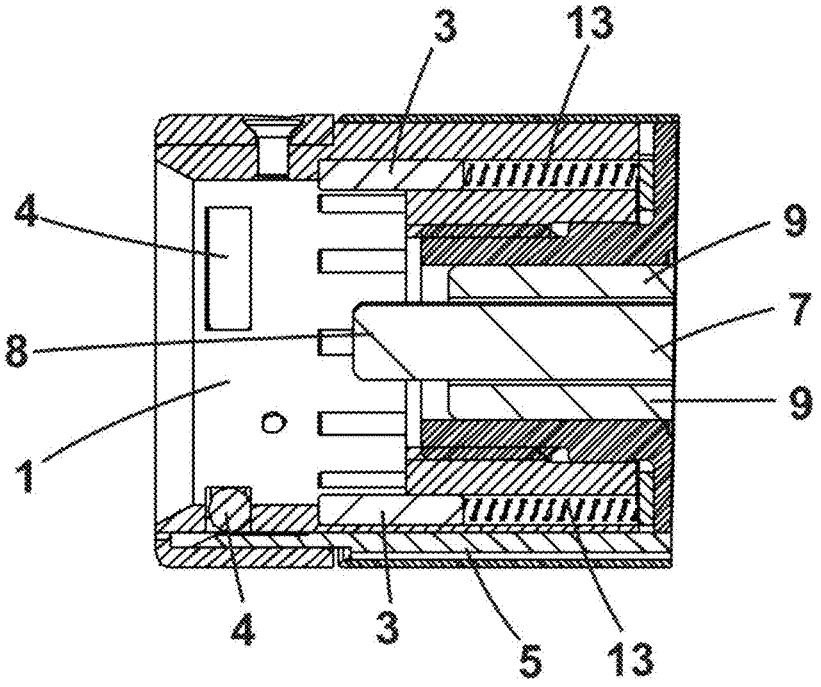
FIG. 2 portrays an enlarged detail of the sectional side view of the tool, corresponding to the nozzle for the fastener, showing the locking elements and the grasping units.
Figure 3:
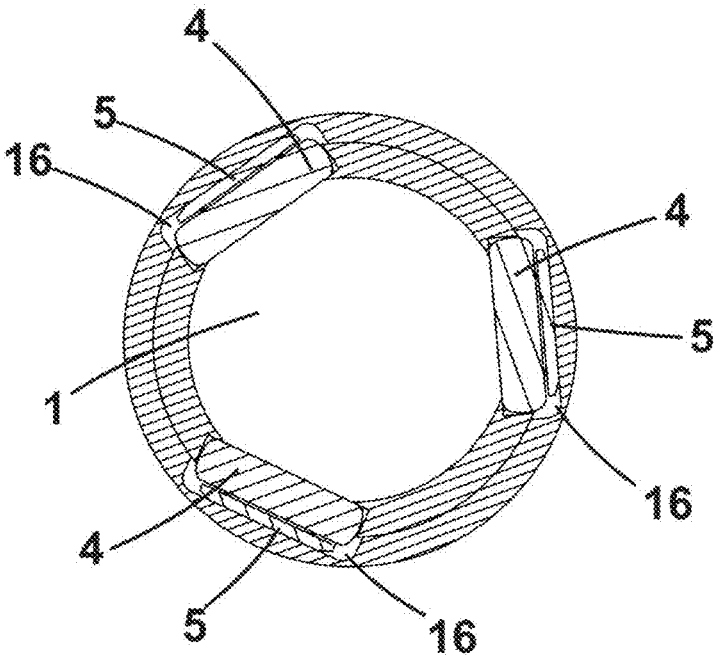
FIG. 3 portrays a section of the nozzle for the fastener, corresponding to the area of the locking elements.
Figure 4:
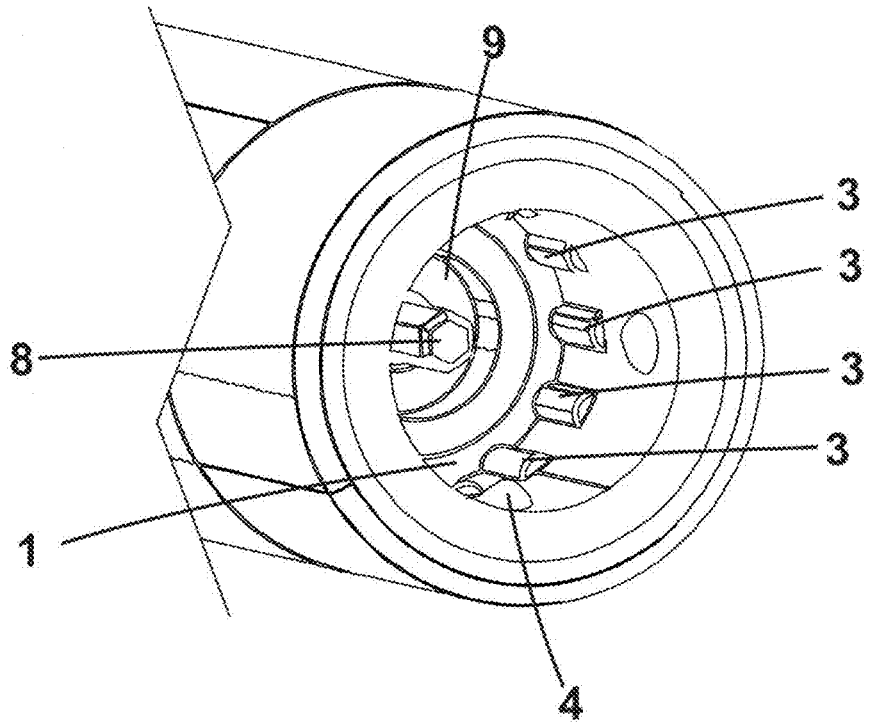
FIG. 4 portrays an enlarged detail in perspective of the tool nozzle, showing the locking elements and the grasping units.
Figure 5:
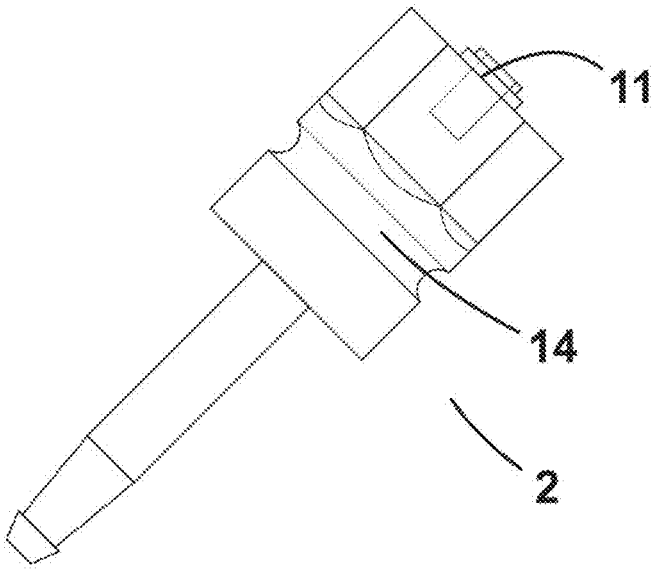
FIG. 5 portrays an example of a temporary fastener that can be used with this tool.
Figure 6:
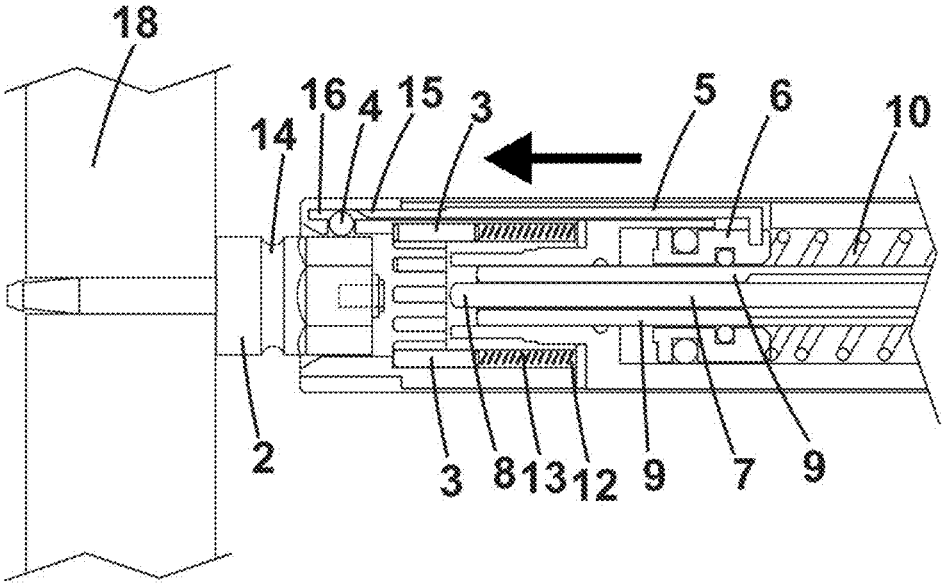
FIG. 6 portrays a simplified detail of a side view of the front of the tool during the step of tool engagement with the temporary fastener.
Figure 7:
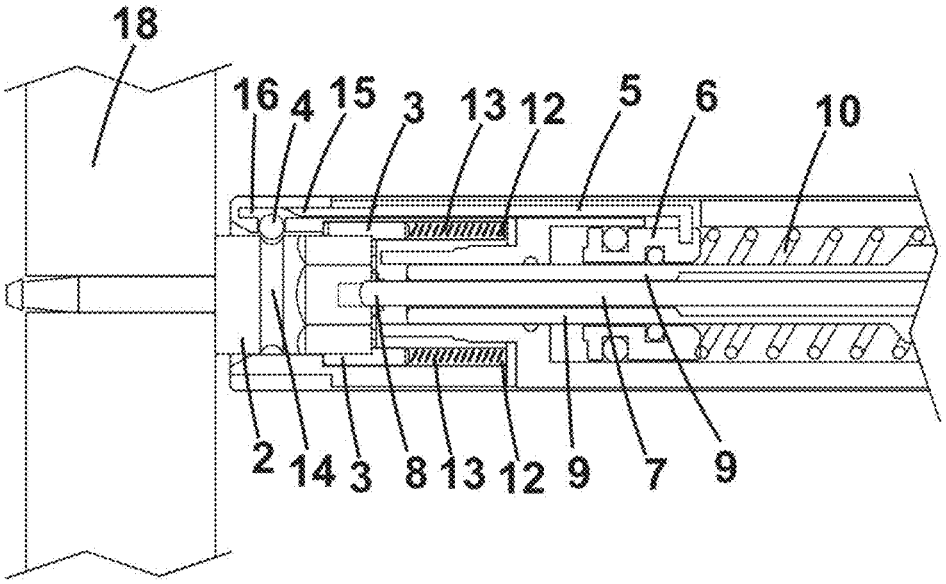
FIG. 7 portrays a simplified detail of a side view of the front of the tool during the step of engaging the temporary fastener via the hexagon forming the head of the clamp.
Figure 8:
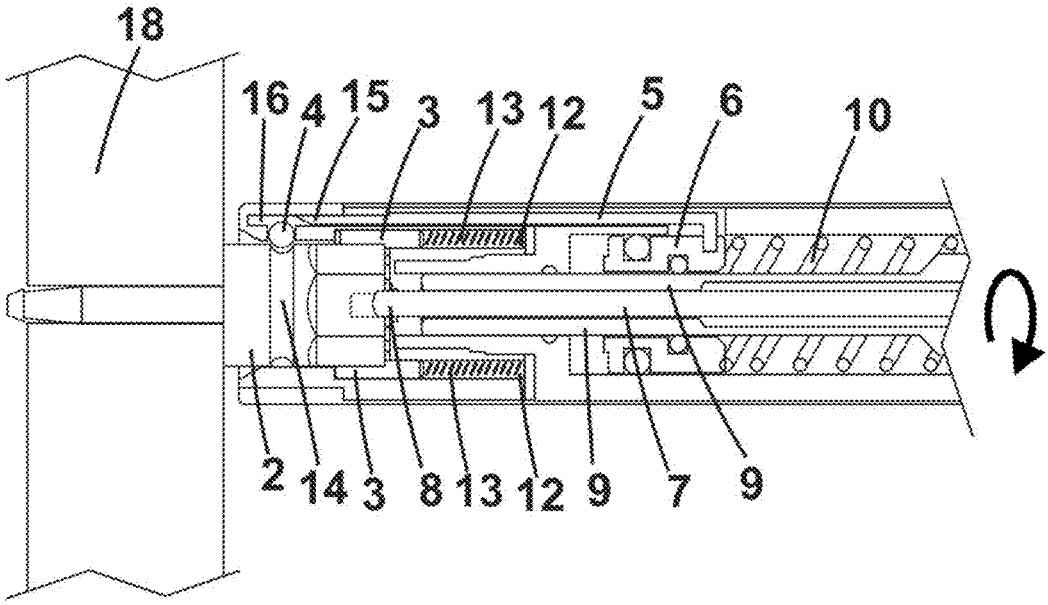
FIG. 8 portrays a simplified detail of a side view of the front of the tool during the step of inserting the actuating key into the temporary fastener.
Figure 9:
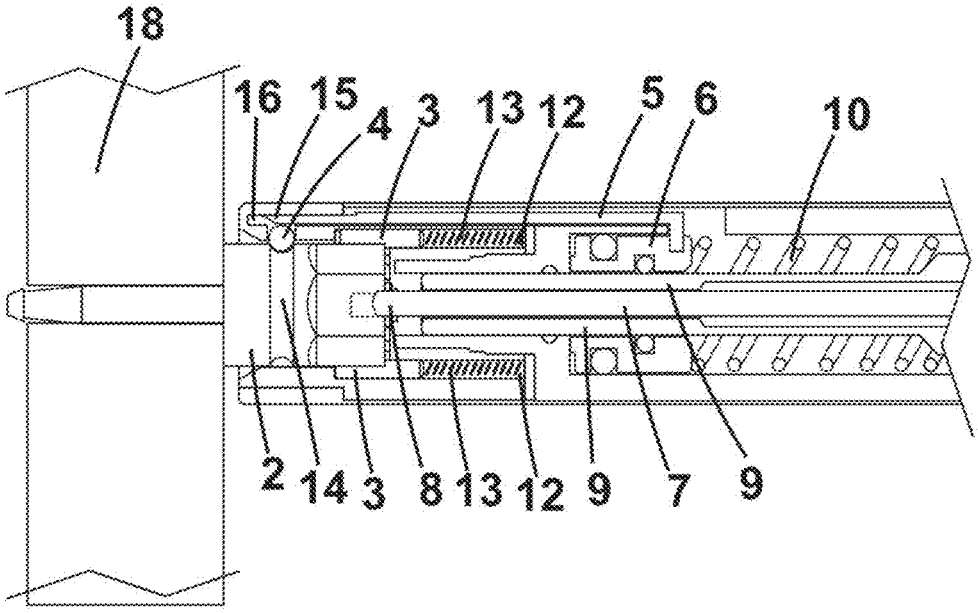
FIG. 9 portrays a simplified detail of a side view of the front of the tool during the step of locking the temporary fastener.
Figure 10:
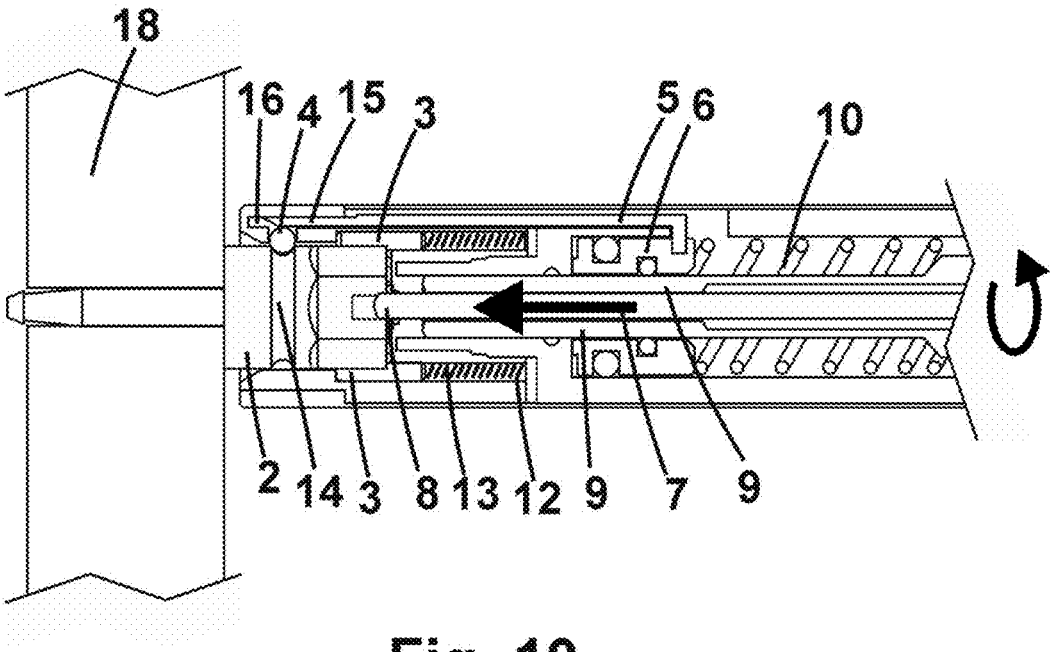
FIG. 10 portrays a simplified detail of a side view of the front part of the tool during the step of releasing the pre-load of the temporary fastener by means of the actuating key.
Figure 11:
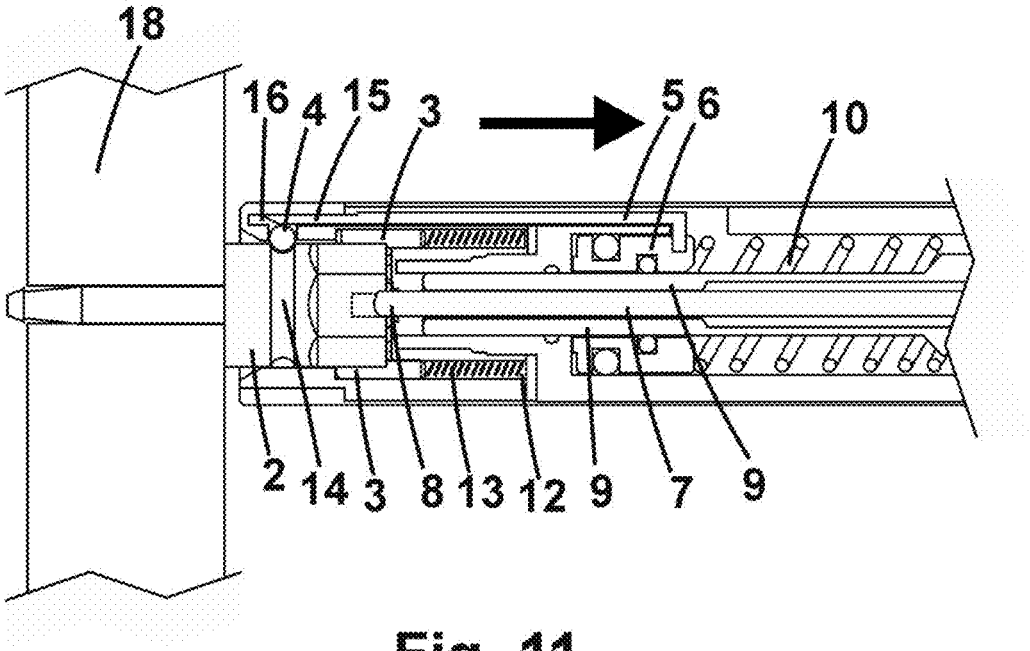
FIG. 11 portrays a simplified detail of a side view of the front of the tool during the step of removing the temporary fastener from the component being worked on, when commencing extraction.
Figure 12:
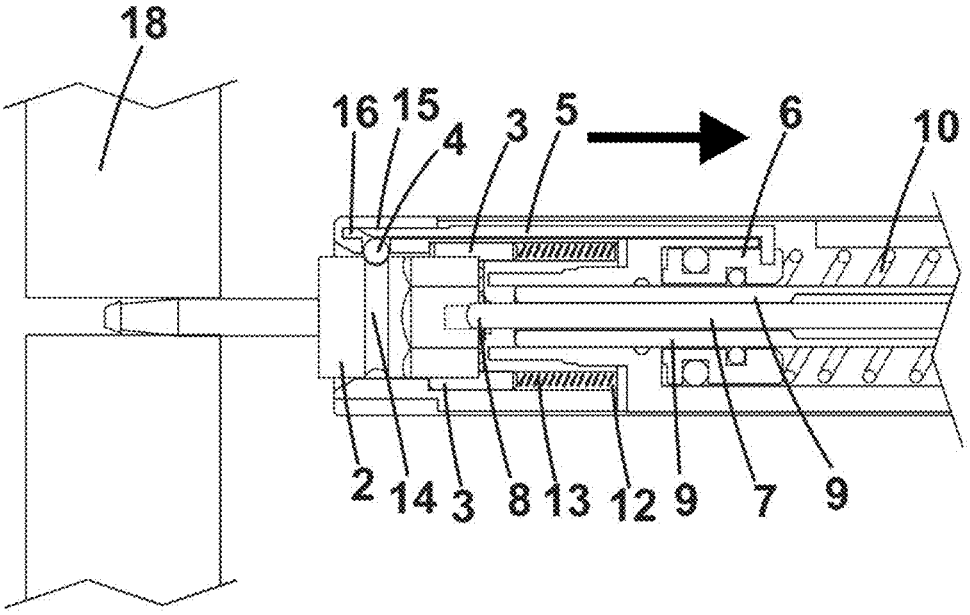
FIG. 12 portrays a simplified detail of a side view of the front of the tool during the step of removing the temporary fastener from the component being worked on, during extraction.
Figure 13:
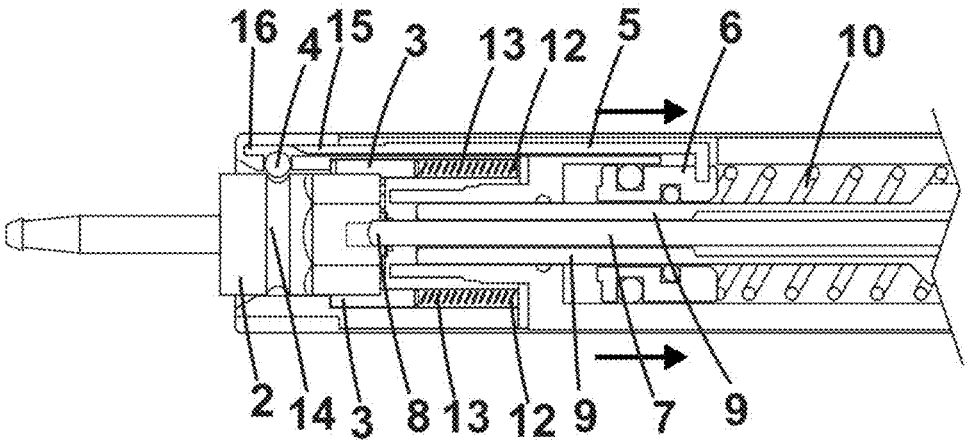
FIG. 13 portrays a simplified detail of a side view of the front of the tool during the step of releasing the temporary fastener lock.
Figure 14:
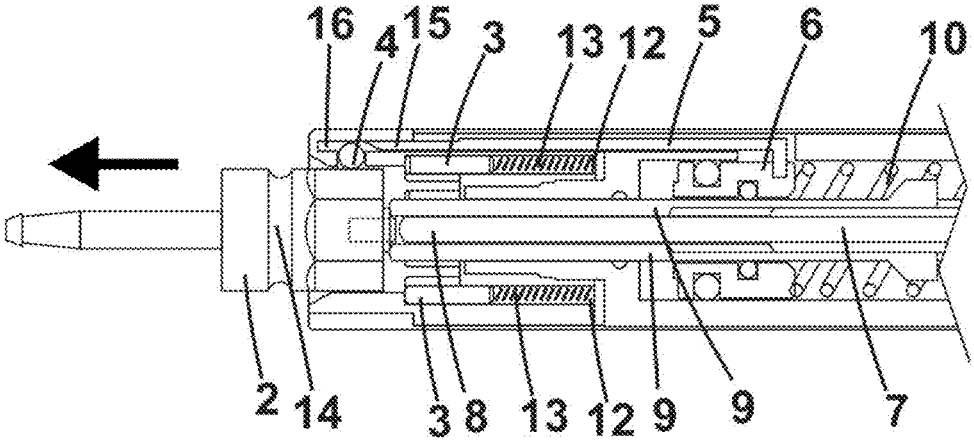
FIG. 14 portrays a simplified detail of a side view of the front of the tool during the step of ejecting the temporary fastener into its store.

The tool for inserting and extracting temporary clamps which is the object of the present invention, is basically characterized, as may be seen in the attached drawing, in that the nozzle (1) for the temporary fastener (2) has a cylindrical opening and comprises:

- one or more retractable elements (3), inserted into an axially disposed housing (12) and distributed peripherally on the inside of the nozzle (1), and partially embedded in the inside wall of the nozzle (1),
- one or more grasping units (4), also distributed peripherally on the inside of the nozzle, in a position closer to the outside and coinciding with the channel (14) of the corresponding temporary fastener (2) once inserted into the nozzle (1), associated with a number of axially sliding locking elements (5); all of these related to an internally sliding actuating cylinder (6), held in the locked position by an internal spring (10), which can optionally be replaced by a thrust cylinder,
- a key (7) located in the central part of the tool, the head (8) thereof featuring a machined section suited to engage with that required for the actuation of the inner part (11) of the temporary fastener (2), and featuring axial and rotational movement,
- one or more ejectors (9) disposed parallel to and adjacent to the key (7) endowed with axial movement.

The retractable elements (3) may adopt an extended position in which each retractable element (3), independently of the others, is maintained in its position closest to the nozzle opening (1) by the thrust of a spring (13) inserted in the housing (12), or in a retracted position in which, independently of the others, the retractable element (3) which due to its coincident position is pushed by the head of the temporary fastener (2) when inserted into the nozzle (1), moves axially into the housing (12), pressing against the spring (13).

These retractable elements (3) are distributed peripherally inside the nozzle (1) in such a way that, once the head of the temporary fastener (2) has been inserted into the nozzle (1), and depending on its position, some or all of the retractable elements (3) remain in their extended position, laterally enveloping the head of the temporary fastener (2). The shape of the retractable elements (3) shall preferably be cylindrical, and the preferred number of retractable elements (3) is 12, which, according to experimental tests, has proved to be the most effective for temporary components (1) with hexagonal heads, although the number may be configurable depending on the shape of the head of the temporary fastener.

The grasping units (4) can also adopt a free position in which the cylinder (6) and its locking elements (5) slide into the tool, compressing the spring (10) in such a way that the bevelled extremity (15) of the locking elements (5) remains in a position away from the grasping units (4), these being free to move within their housings (16), or a locked position where the cylinder (6) and its locking elements (5) are slid towards the tool nozzle (1) due to the thrust of the spring (10) in such a way that the bevelled end (15) of the locking thrusters (5) lies on the grasping units (4), locking them against the opening of their housing (16) into the nozzle (1).

These grasping units (4) have a shape, depending on the channel of the temporary fastener, chosen from the group formed by cylindrical and spherical, being preferably cylindrical, and there being preferably 3 grasping units (4).

The key (7) is coupled by means of a connector (17) to a rotary actuator selected among electric, pneumatic, hydraulic or mechanical systems.

The ejector (9) is preferably of the hollow cylindrical type disposed coaxially to the key (7) and next to the same.

This tool for the insertion and extraction of temporary fasteners also has a characteristic operating procedure, which may be divided into two parts, one for the extraction of temporary parts (1) inserted into a component (18), and the opposite process of insertion of temporary parts (1) from the store to the component (18), sharing many common steps.

The tool is equipped with the appropriate position, status and force sensors necessary to control the movement and status of the different internal elements and to facilitate the programming of its automated use.

To extract a temporary fastener (2) fixed in a component (18):

first of all, a step of engaging the tool nozzle with the temporary fastener (2) is performed, with the automatic gripping of the temporary fastener (2)

secondly, a step consisting of locking the temporary fastener (2), thirdly, a step where the key (7) is inserted into the temporary fastener, the fourth step is to release the pre-load of the temporary fastener (2), in fifth place a step of extracting the temporary fastener (2) from the component (18) being worked on, the sixth step is to release the temporary fastener (2), and the seventh step is to eject the temporary fastener (2) into its store.

To carry out the insertion of a temporary fastener (2) into a component (18), one should proceed as follows:

first of all, the step of engaging the tool nozzle in the temporary fastener (2), located in the store or received automatically by the feed system, with automatic grasping of the head of the temporary fastener secondly, a step consisting of locking the temporary fastener (2), thirdly, a step of inserting the temporary fastener (2) into the component (18) through a hole drilled previously, fourthly, a step of inserting the key (7) into the temporary fastener, in fifth place a step of pre-loading the temporary fastener (2), the sixth step is to release the temporary fastener (2), and in seventh place, the step of extracting the tool, leaving the temporary fastener (2) gripped in the component.

The step of engaging the tool in the temporary fastener (2), comprises the forward movement of the tool by means of the external actuation module, inserting it in a given position, the retractable elements (3) adopting an extended or retracted position depending on the relative positions of the head of the temporary fastener (2) and the nozzle (1) of the tool.

The step of locking the temporary fastener (2) by means of the radial channel. It comprises the forward movement of the tool while the gripping elements (4), being free-moving, are retracted by the thrust of the head of the fastener (2).

The step of inserting the key (7) into the temporary fastener is carried out by turning the key at a reduced speed and with controlled torque, detecting the moment of connection.

The step of locking the temporary clamp (2) is carried out by releasing the pressure on the actuating cylinder (6), thereby activating the spring (10) that pushes the locking elements (5) forward, locking the gripping items (4), which engage in the channel (14) of the temporary fastener (2).

The step of releasing the pre-load of the temporary fastener (2) is carried out by turning the motor of the external actuator module, causing the key (7) to rotate inside the temporary fastener (2) at a programmed speed and with a certain release torque.

The step of extraction of the temporary clamp (2) from the component (18) being worked on is carried out by means of the withdrawal of the tool and the temporary fastener (2) solidary with it, from the external actuator module.

The step of releasing the temporary fastener (2) is carried out by means of the entry of air into the actuating cylinder (6), moving it rearward together with the locking elements (5), unlocking the grasping units (4), which once free can now leave the channel (14) of the temporary fastener (2).

The step of ejecting the temporary fastener (2) into its store involves maintaining the actuating cylinder (6) actuated in order to hold the locking elements (5) back, and actuating the ejector or ejectors (9) to push the fastener out and deposit it in its store.

The step of insertion of the temporary clamp (2) into the component (18) through a previously drilled hole is carried out by means of the forward movement performed by the tool and the temporary fastener (2) solidary therewith, driven by the external actuator module.

The step of pre-loading the temporary fastener (2) is carried out by turning the motor of the external actuator module, causing the key (7) to rotate inside the temporary fastener (2) at a programmed speed and with a certain tightening torque.

The step of extracting the tool leaving the temporary fastener (2) grasped by the component is carried out by means of the rearward movement performed by the tool, drawn by the external actuator module.

During the step of inserting the tool into the temporary clamp (2), the retractable elements (3) adopt an extended or retracted position depending on the relative position of the temporary fastener head (2) with the nozzle (1) of the tool. This is shown experimentally in the following simulations performed:

The specific use of this tool is for the insertion and extraction of temporary fasteners (2) with different head shapes, in particular a hexagonal shape, although it is easily adaptable to other types of head, such as octagons, 36-spiked splines, etc.

In FIG. 15, several examples with a temporary fastener with a hexagonal head (2) may be seen, centred with regard to the nozzle (1) of the tool, with different relative rotation angles.

Figure 15A:
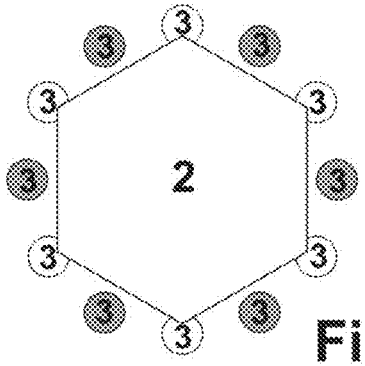
FIGS. 15*a* to 15*g* portray several examples of engagement with a type of temporary fastener which is centred regarding the tool nozzle, with different relative angles of rotation, showing shaded the retractable elements that remain in the extended position, and which may be locked.

Thus, in FIG. 15*a* a temporary fastener (2) centred with regard to the nozzle (1) may be seen, with an angle from the vertical of 0°. In this case, 6 retractable elements (3) would be in the retracted position, and 6 retractable elements (3) would be in the extended position.

Figure 15B:
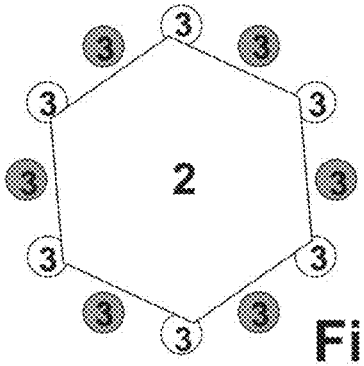

In FIG. 15*b* a temporary fastener (2) centred with regard to the nozzle (1) may be seen, with an angle from the vertical of 5°. In this case 6 retractable elements (3) would be in the retracted position and 6 retractable elements (3) would be in the extended position.

Figure 15C:
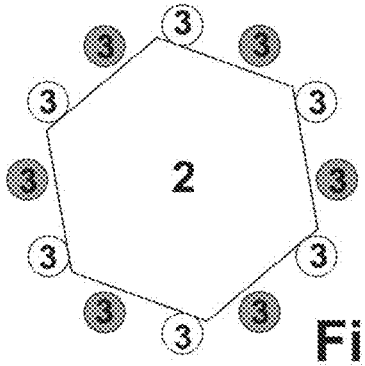

In FIG. 15*c* a temporary fastener (2) centred with regard to the nozzle (1) may be seen, with an angle from the vertical of 10°. In this case 6 retractable elements (3) would be in the retracted position and 6 retractable elements (3) would be in the extended position.

Figure 15D:
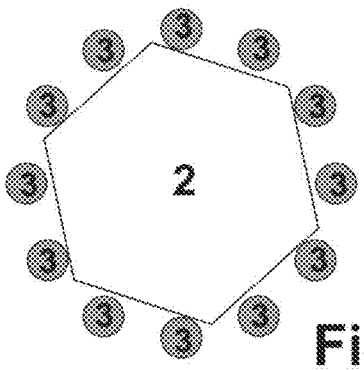

In FIG. 15*d* a temporary fastener (2) centred with regard to the nozzle (1) may be seen, with an angle from the vertical of 12°. In this case 12 retractable elements (3) would be in the extended position.

Figure 15E:
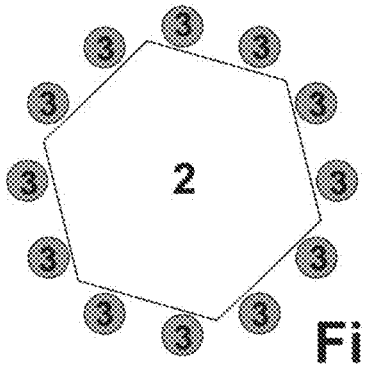

In FIG. 15*e* a temporary fastener (2) centred with regard to the nozzle (1) may be seen, with an angle from the vertical of 14°. In this case 12 retractable elements (3) would be in the extended position.

Figure 15F:
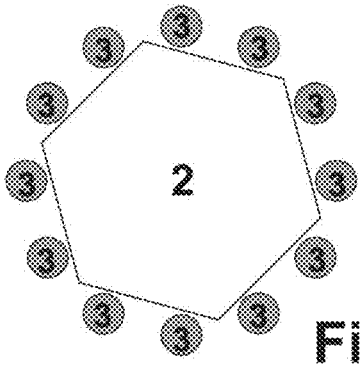

In FIG. 15*f* a temporary fastener (2) centred with regard to the nozzle (1) may be seen, with an angle from the vertical of 5°. In this case 12 retractable elements (3) would be in the extended position.

Figure 15G:
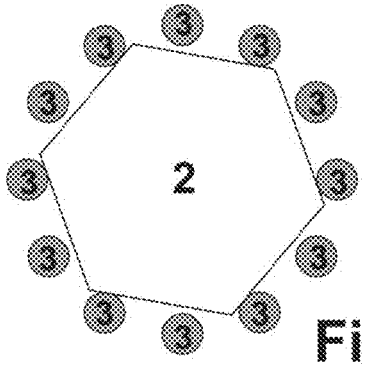

In FIG. 15*g* a temporary fastener (2) centred with regard to the nozzle (1) may be seen, with an angle from the vertical of 20°. In this case 12 retractable elements (3) would be in the extended position.

We verify that in all these cases the rotation of the temporary fastener (2) inside the tool is halted.

In FIG. 16 several examples with the temporary fastener (2) 0.3 mm. off-centre with regard to the nozzle (1) of the tool may be seen, with different relative rotation angles.

Figure 16A:
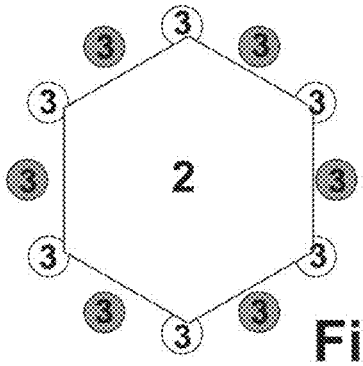
FIGS. 16*a* to 16*g* portray several examples of engagement with a type of temporary fastener that is off-centre regarding the tool nozzle, with different relative angles of rotation, showing shaded the retractable elements that remain in the extended position.

In FIG. 16*a* a temporary clamp (2) centred with regard to the nozzle (1) may be seen, with an angle from the vertical of 0°, and 0.3 mm off-centre. In this case 6 retractable elements (3) would be in the retracted position and 6 retractable elements (3) would be in the extended position.

Figure 16B:
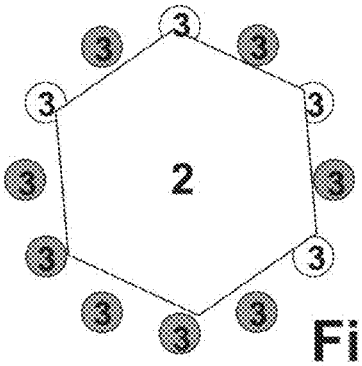

In FIG. 16*b* a temporary fastener (2) centred with regard to the nozzle (1) may be seen, with an angle from the vertical of 5°, and 0.3 mm off-centre. In this case 4 retractable elements (3) would be in the retracted position and 8 retractable elements (3) would be in the extended position.

Figure 16C:
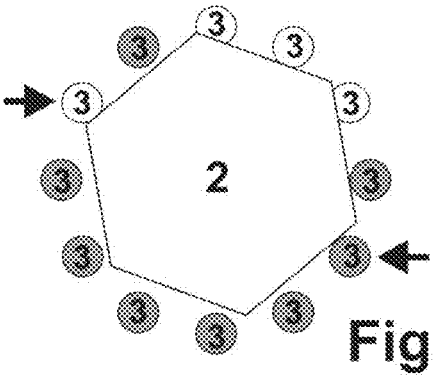

In FIG. 16*c* a temporary fastener (2) centred with regard to the nozzle (1) may be seen, with an angle from the vertical of 10°, and 0.3 mm off-centre. In this case 4 retractable elements (3) would be in the retracted position and 8 retractable elements (3) would be in the extended position, and at this moment, two retractable elements (3) tend to centre the fastener.

Figure 16D:
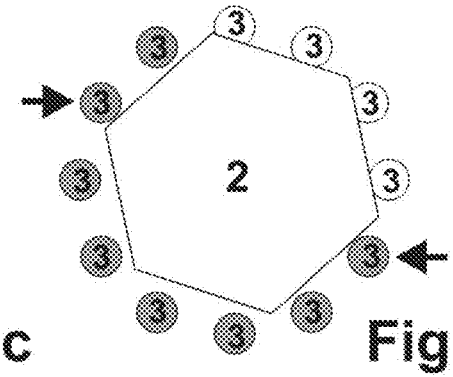

In FIG. 16*d* a temporary fastener (2) centred with regard to the nozzle (1) may be seen, with an angle from the vertical of 12°, and 0.3 mm off-centre. In this case 4 retractable elements (3) would be in the retracted position and 8 retractable elements (3) would be in the extended position.

Figure 16E:
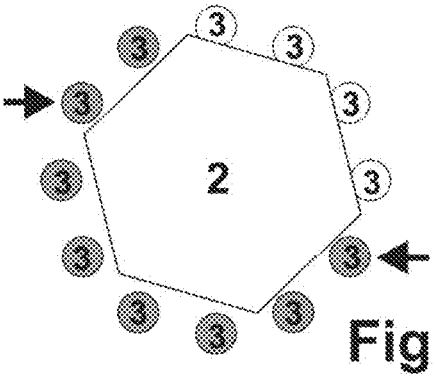

In FIG. 16*e* a temporary fastener (2) centred with regard to the nozzle (1) may be seen, with an angle from the vertical of 14°, and 0.3 mm off-centre. In this case 4 retractable elements (3) would be in the retracted position and 8 retractable elements (3) would be in the extended position.

Figure 16F:
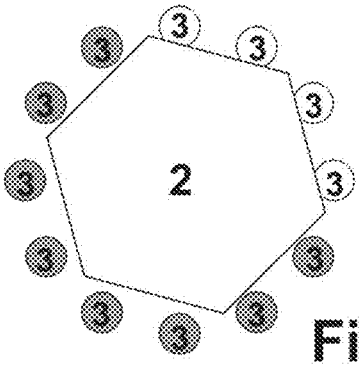

In FIG. 16*f* a temporary fastener (2) centred with regard to the nozzle (1) may be seen, with an angle from the vertical of 15°, and 0.3 mm off-centre. In this case 4 retractable elements (3) would be in the retracted position and 8 retractable elements (3) would be in the extended position.

Figure 16G:
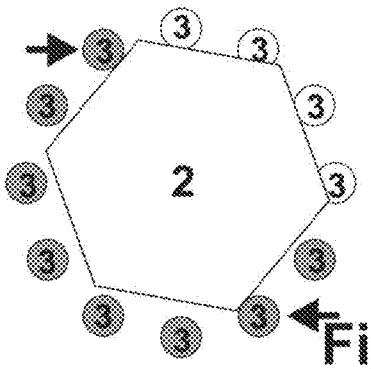

In FIG. 16*g* a temporary fastener (2) centred with regard to the nozzle (1) may be seen, with an angle from the vertical of 20°, and 0.3 mm off-centre. In this case 4 retractable elements (3) would be in the retracted position and 8 retractable elements (3) would be in the extended position.

We verify that in all these cases the rotation of the temporary fastener (2) is locked within the tool.

It will be easy for any person skilled in the art to understand that the characteristics of different embodiments can be combined with characteristics of other possible embodiments whenever such a combination is technically possible.

All the information referring to examples or modes of embodiment, form part of the description of the invention.

The invention claimed is:

1. A tool for the insertion, installation and extraction of temporary fasteners of the type used in the aeronautical industry for the temporary joining of components during machining, drilling or shaving removal processing, associated with an external actuator module, characterized in that the nozzle (1) for the temporary fastener (2) has a cylindrical opening and comprises:

- one or more retractable elements (3), inserted into an axially disposed housing (12) and distributed peripherally on the inside of the nozzle (1), and partially embedded in the inside wall of the nozzle (1),
- one or more gripping units (4), also distributed peripherally on the inside of the nozzle, in a position closer to the outside and coinciding with a channel (14) of the temporary fastener (2) once inserted into the nozzle (1), associated with axially sliding locking elements (5) related to an internally actuated cylinder (6),
- a key (7) located in the central part of the tool, the head (8) thereof featuring a machined section suited to engage with that required for the movement of the inner part (11) of the temporary fastener (2), and featuring axial and rotational movement,
- one or more ejectors (9) disposed parallel to and adjacent to the key (7) endowed with axial movement.

2. The tool for the insertion and extraction of temporary fasteners, as claimed in claim 1, characterized by an extended position of the retractable elements (3) where each retractable element (3), independently of the others, is maintained in its extended position closest to the opening of the nozzle (1) by the thrust of a spring (13) inserted in the housing (12).

3. The tool for the insertion and extraction of temporary fasteners, as claimed in claim 1, characterized in that a retracted position of the retractable elements (3) where, independently of the others, the retractable element (3) which, due to its coincident position, is pushed by the head of the temporary fastener (2) when inserted into the nozzle (1), and moves axially towards the inside of the housing (12), pressing the spring (13).

4. The tool for the insertion and extraction of temporary fasteners, as claimed in claim 1, characterized in that the retractable elements (3) are distributed peripherally inside the nozzle (1) in such a way that, once the head of the temporary fastener (2) is inserted into the nozzle (1), and depending on its position, some or all of the retractable elements (3) remain in their extended position, laterally enveloping the head of the temporary fastener (2).

5. The tool for the insertion and extraction of temporary fasteners, as claimed in claim 1, characterized in that the retractable elements (3) are cylindrical.

6. The tool for the insertion and extraction of temporary fasteners, as claimed in claim 1, characterized in that there are 12 retractable elements (3).

7. The tool for the insertion and extraction of temporary fasteners, as claimed in claim 1, characterized by a free position of the gripping units (4) where the cylinder (6) and its locking elements (5) are slid into the tool, in such a way that the bevelled end (15) of the locking elements (5) remains in a position away from the gripping units (4), the latter remaining free to move within their housing (16).

8. The tool for the insertion and extraction of temporary fasteners, as claimed in claim 1, characterized by a locked position of the gripping units (4) where the cylinder (6) and its locking elements (5) are slid towards the nozzle (1) of the tool, in such a way that the bevelled end (15) of the locking elements (5) presses the gripping units (4), engaging them against the opening of their housing (16) towards the inside of the nozzle (1) and the channel of the fastener.

9. The tool for the insertion and extraction of temporary fasteners, as claimed in claim 1, characterized in that the gripping elements (4) feature a shape chosen from the group formed by cylindrical and spherical.

10. The tool for the insertion and extraction of temporary fasteners, as claimed in claim 1, characterized in that there are 3 gripping elements (4).

11. The tool for the insertion and extraction of temporary fasteners, as claimed in claim 1, characterized in that the key (7) is linked by means of a connector (17) to an external rotary actuator.

12. The tool for the insertion and extraction of temporary fasteners, as claimed in claim 1, characterized in that the ejector (9) is hollow and cylindrical and is coaxially disposed to and adjacent to the key (7).

* * * * *